United States Patent [19]

Lambertson

[11] 3,998,332

[45] Dec. 21, 1976

[54] POT RACK

[76] Inventor: Theodore C. Lambertson, 1369 Rollins Road, Burlingame, Calif. 94010

[22] Filed: Nov. 3, 1975

[21] Appl. No.: 627,952

[52] U.S. Cl. ..... 211/13; 211/123; 211/182; 248/215

[51] Int. Cl.[2] ..... A47F 7/00

[58] Field of Search ..... 211/71, 13, 123, 124, 211/105.1, 182; 248/214, 215, 340, 304, 307; 72/367

[56] References Cited

UNITED STATES PATENTS

| | | | |
|---|---|---|---|
| 1,703,601 | 2/1929 | Shipway | 211/182 |
| 1,734,710 | 11/1929 | Borchert | 72/367 |
| 1,814,692 | 7/1931 | Harris | 211/123 |
| 1,891,785 | 12/1932 | Siebert et al. | 72/367 |
| 1,954,384 | 4/1934 | Hurt | 211/71 X |
| 2,205,893 | 6/1940 | Unger | 72/367 |
| 2,576,049 | 11/1951 | Shott | 211/182 UX |
| 2,950,003 | 8/1960 | Simmons et al. | 211/123 X |
| 3,863,769 | 2/1975 | Goddard | 211/182 |
| 3,886,780 | 6/1975 | Falk | 72/367 X |

FOREIGN PATENTS OR APPLICATIONS

| | | | |
|---|---|---|---|
| 526,375 | 6/1956 | Canada | 248/215 |
| 11,754 | 10/1909 | United Kingdom | 211/182 |

*Primary Examiner*—Ramon S. Britts
*Assistant Examiner*—Robert W. Gibson, Jr.
*Attorney, Agent, or Firm*—Owen, Wickersham & Erickson

[57] ABSTRACT

A pot rack has a horizontal rack member which is made by pressing a tube length to a generally flattened shape. The width of the die used in the pressing operation is less than the flattened width of the tube, and the outside edge portions of the flattened tube which are not engaged by the die provide longitudinally extending flanges. The resulting flanged rack member is quite rigid and highly resistant to twisting or deflection in use. It is produced at substantially less cost than the conventional flat bar type of pot racks.

8 Claims, 5 Drawing Figures

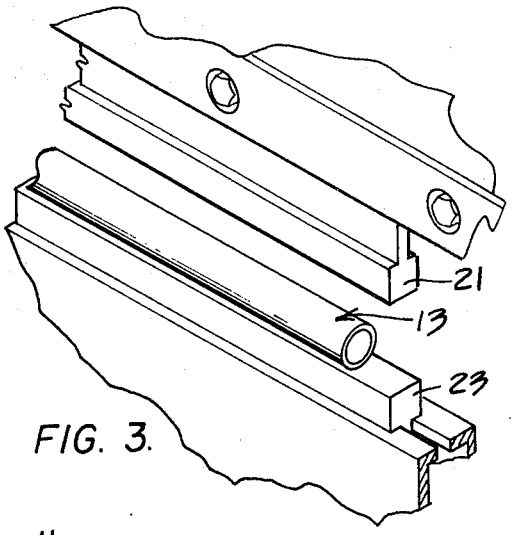
FIG. 3.
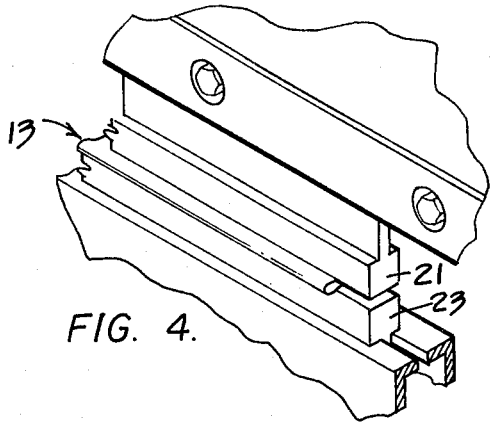
FIG. 4.
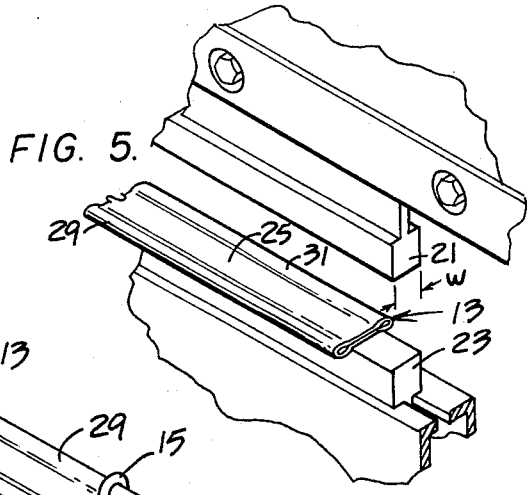
FIG. 5.
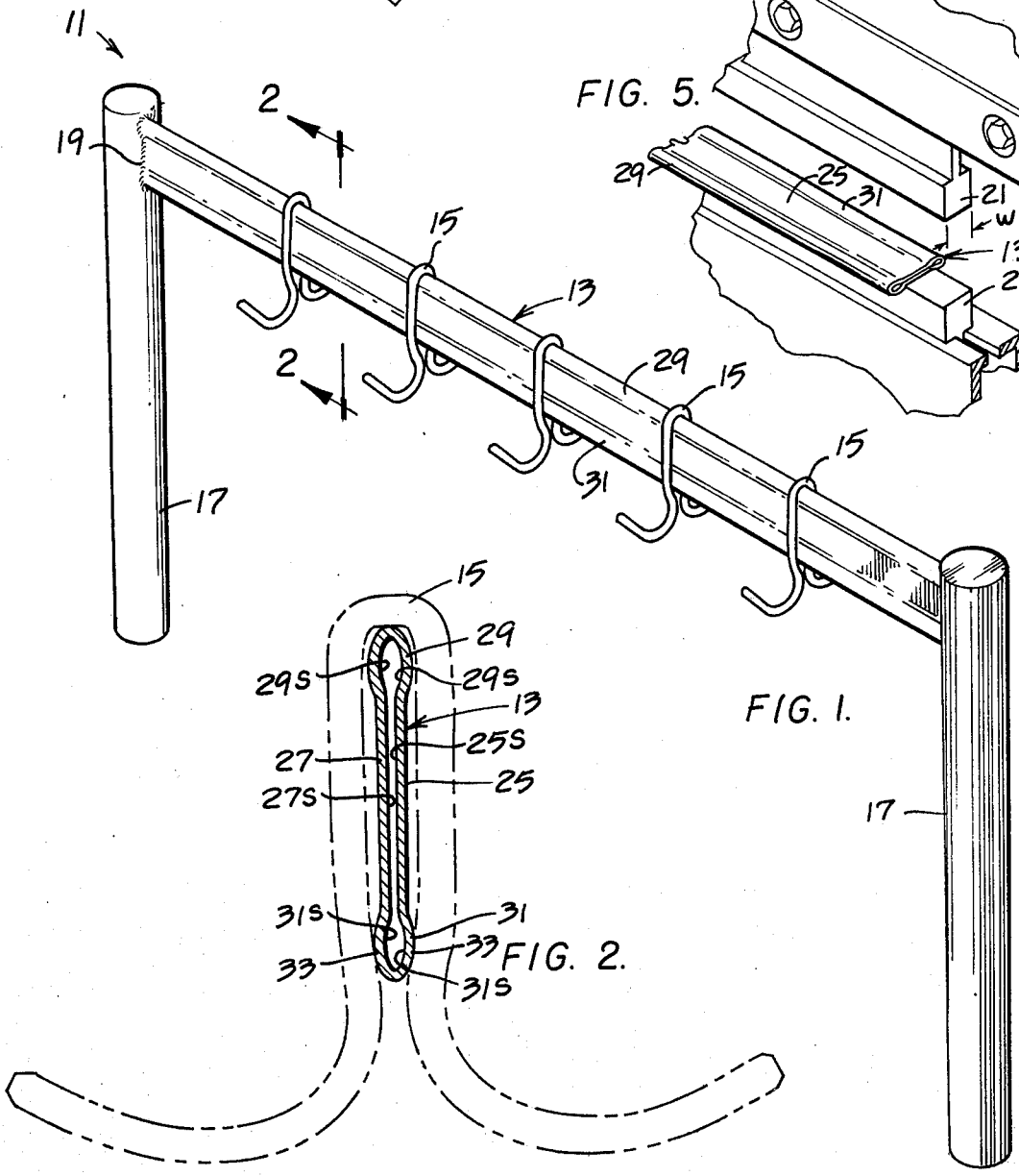
FIG. 1.
FIG. 2.

POT RACK

BACKGROUND OF THE INVENTION

This invention relates to a pot rack of the kind in which a number of pot hooks are suspended from a generally horizontally extending rack member.

Pot racks of the kind to which the present invention relates have conventionally been constructed of two uprights and a flat, solid bar connected between the uprights. For example, a conventional pot rack in commercial use has a flat bar 2 inches high by ¼ inch thick mounted between two uprights. A number of pot hooks are slipped over the top edge of the bar for holding pots or other kitchen utensils from the hooks.

The prior art pot racks using flat bars of this kind have been relatively expensive and have not been as rigid as desired. The flat bar also does not provide the desired tight fit between the hooks and the flat bar. Instead, the hooks have tended to slide around on the bar in somewhat of a sloppy fit.

It is an important object of the present invention to construct a pot rack incorporating a pressed tube for the rack member in a way that overcomes the disadvantages of the prior art pot racks using flat bar stock as described above.

SUMMARY OF THE INVENTION

The pot rack of the present invention incorporates a tube length which is pressed to a generally flat shaped rack member having two centrally extending side wall sections and two peripheral edge portions of greater width than the central section. The tube member has an outer polished surface, and rubber strips are used on the die faces for preventing marring of the polished surface during the pressing operation. Each die used in the pressing operation has a width which is less than that of the overall width of the pressed tube so that the pressing operation forms outer flanges extending along the length of the pressed tube at each outside edge of the pressed tube. This provides a modified I beam shape in cross section having a section modulus which is quite resistant to twisting and deflection. The pressed rack member is then welded at each end to a support post with the rack member aligned so that the flanges are at the top and at the bottom of the rack member.

This provides a very rigid pot rack, because of the flanged end configuration of the cross member; and the pot rack can be manufactured at substantially less cost (about one-fourth the cost) of conventional pot racks using flat bar stock for the cross member.

The flanged top and bottom edge configuration of the horizontally extending rack member also has the advantage of retaining the pot hooks in a fixed position on the rack without slipping because the flanges provide good frictional contact with the pot hooks when the hooks are pressed down into position over the rack member.

Pot rack apparatus and methods which incorporate the structure and techniques described above and which are effective as described above constitute specific objects of this invention.

Other and further objects of the present invention will be apparent from the following description and claims and are illustrated in the accompanying drawings which by way of illustration, show preferred embodiments of the present invention and the principles thereof and what are now considered to be the best modes contemplated for applying these principles. Other embodiments of the invention embodying the same or equivalent principles may be used and structural changes may be made as desired by those skilled in the art without departing from the present invention and the purview of the appended claims.

BRIEF DESCRIPTION OF THE DRAWINGS

FIG. 1 is an isometric view showing a pot rack constructed in accordance with one embodiment of the present invention;

FIG. 2 is an end elevation view in cross section taken along the line and in the direction indicated by the arrows 2—2 in FIG. 1; and FIGS. 3, 4 and 5 are fragmentary isometric views showing progressive steps in the forming of the rack member from a hollow tube shape to the generally flat shaped rack member. FIGS. 4 and 5 illustrate how the press die has a width which is less than the flattened height of the rack member to form flanges extending longitudinally along the upper and lower edges of the rack member.

DESCRIPTION OF THE PREFERRED EMBODIMENTS

A pot rack constructed in accordance with one embodiment of the present invention is indicated generally by the reference numeral 11 in FIG. 1.

The pot rack 11 comprises a horizontally extending rack member 13, pot hooks 15 and support posts 17.

The rack member 13 is connected to the posts 17 by weld 19 at each end of the rack member 13.

As best illustrated in FIGS. 3, 4 and 5, the rack member 13 is made by pressing a length of a hollow tube to the generally flat shaped rack member in a mechanical press having an upper die 21 and a lower die 23.

The tube is a stainless steel tube having a polished outer surface, and a rubber strip (not illustrated in the drawings) is used on the face of each die 21 and 23 so that the polished surface will not be marred during the pressing operation.

As best illustrated in FIG. 5, the width W of each die is less than the height of the flattened rack member 13 so that the die faces engage only the central side wall sections 25 and 27 (see FIG. 2) and do not engage the peripheral edge portions 29 and 31 of the rack member 13. As a result, the top and bottom edges of the rack member 13 are formed with enlarged flanges 29 and 31 having spaced apart inside surfaces 29S and 31S (again see FIG. 2). The upper and lower flanged or ribbed configuration imparts a significant amount of structural rigidity, due to the enlarged section modulus, so that the rack member 13 of the present invention is substantially more resistant to twisting and flexing than the conventional rectangular bar used for most pot racks.

The flanged construction of the rack member 13 of the present invention has a further advantage in that it keeps hooks 15 in place without slippage on the rack in normal use.

As best illustrated in FIG. 2, each hook 15 is a conventional resilient clip type hook having two side portions which extend down along side the side wall sections 25 and 27 of the rack member and beyond the lower flange or rib 31 of the rack member. The lower flange 31 has sufficient lateral thickness to cause the inside surfaces of the hooks to engage the lower flange, at the areas 33, with sufficient frictional force to hold the hooks in place without slippage on the rack in normal use.

In the preferred form of the present invention the pressing operation is stopped while the inside surfaces 25S and 27S of the side wall sections are laterally spaced apart, since this provides increased rigidity in the installed rack member.

The pot rack of the present invention is produced at much lower cost than conventional pot racks using flat bar stock for the rack member. By starting with tubing and flattening it, the pot rack of the present invention can be produced at about one-fourth of the cost of making an equivalent size pot rack by conventional techniques with flat bar stock.

The present invention has a further advantage in that it is not necessary to polish the sides of the rack member after fabrication, as is the case with conventional flat bar pot racks, since it is possible to use a tube already having a polished surface.

The pot rack member 13 and entire pot rack assembly has substantially more ridigity than an equivalent size conventional pot rack using flat bar stock, because of the increased section modulus provided by the pressed tube rack member of the present invention.

The pot rack hooks 15, with the present invention, can be clipped on the rack member 13 at a desired location; and the frictional contact between the hook and the enlarged lower flange then tends to prevent subsequent sliding around of hooks along the length of the rack member during normal use of the pot rack.

While I have illustrated and described the preferred embodiments of my invention, it is to be understood that these are capable of variation and modification, and I therefore do not wish to be limited to the precise details set forth, but desire to avail myself of such changes and alterations as fall within the purview of the following claims.

I claim:

1. A method of making a pot rack of the kind in which a plurality of pot hooks are mounted on a horizontally extending rack member and comprising, pressing a tube length to a generally flat shaped rack member having two side wall sections and two peripheral edge portions, supporting the flattened tube rack member substantially horizontally from end-to-end and with the side wall sections extending substantially vertically from a lower edge portion to an upper edge portion, forming, along each peripheral edge portion of the flattened tube rack member, a longitudinally extending hollow flange having laterally spaced apart interior surfaces to provide structural rigidity to the rack, and mounting pot hooks on the flattened tube rack.

2. The invention defined in claim 1 including stopping the pressing operation while the side wall sections are laterally spaced apart to provide increased rigidity in the installed rack member.

3. The invention defined in claim 2 wherein the pot hooks are resilient clip type hooks with each hook having two side portions which extend down along side the side wall sections and beyond the lower edge of the rack member and including forming at least the lower flange of the rack with sufficient lateral thickness to cause the inside surfaces of the hooks to engage the rack with sufficient frictional force to hold the hooks in place without slippage on the rack in normal use.

4. The invention defined in claim 1 wherein the tube has an outer polished surface and including pressing the tube to a flat shape with a mechanical die having rubber strips on the die faces for preventing marring of the polished surface.

5. The invention defined in claim 4 wherein the die has less width than the flattened height of the rack member to form flanges extending longitudinally along each peripheral edge of the rack member.

6. A pot rack comprising:

a longitudinally extending rack member formed from a hollow tube length pressed to a generally flat shape and having two central side wall sections connected by two peripheral edge portions, support means for supporting the flattened tube rack member substantially horizontally from end-to-end and with the side wall sections extending substantially vertically from the lower edge portion to the upper edge portion and wherein the inner surfaces of the peripheral edge portions of the rack member are laterally spaced apart to form hollow flange means for imparting structural rigidity to the rack member.

7. The invention defined in claim 6 wherein the inner surfaces of the side wall sections are also laterally spaced apart but to a lesser extent than the inner surfaces of the peripheral edge portions so that the rack member has upper and lower flanges of enlarged width compared to the central member as viewed in cross section along the length of the rack member.

8. The invention defined in claim 7 including pot hooks clipped in place on the rack member with each hook having two side portions extending downwardly along side the side wall sections and beyond the lower edge of the rack and frictionally engaged with at least the lower flange of the rack with sufficient frictional force to hold the hooks in place without slippage on the rack in normal use.

* * * * *